United States Patent [19]

Morrison et al.

[11] 4,359,220

[45] Nov. 16, 1982

[54] MICROCOMPUTER CONTROLLED GAME

[75] Inventors: Howard J. Morrison, Deerfield; Rex M. Harper, Chicago, both of Ill.

[73] Assignee: Marvin Glass & Associates, Chicago, Ill.

[21] Appl. No.: 119,887

[22] Filed: Feb. 8, 1980

[51] Int. Cl.[3] ..... A63F 9/00

[52] U.S. Cl. ..... 273/1 E; 273/273

[58] Field of Search ..... 273/1 E, 237, 273

[56] References Cited

U.S. PATENT DOCUMENTS 4,216,965 8/1980 Morrison et al. ..... 273/1 E

OTHER PUBLICATIONS

"Electronic Games", *Consumer Reports,* Nov. 1979, pp. 635–643.

"Smart Electronic Games and Video Games" by Ahl *Creative Computing,* Nov./Dec. 1978, pp. 70–74.

"Games", *Creative Computing,* Nov. 1979, p. 18.

"The Toy Store Begins at Home" by Ciarcia, *Byte,* Apr. 1979, pp. 10–18.

"Touch-Me" Operating and Maintenance Manual, Atari, 1974.

*Primary Examiner*—Russell E. Adams

*Attorney, Agent, or Firm*—McDermott, Will & Emery

[57] ABSTRACT

A game utilizes a microprocessor for controlling the play of one or more games in which a participant may play against the machine or against another participant. The game includes a portable housing having a top surface subdivided into a plurality of playing areas, each of which playing areas has two manually operable push buttons, and having a microprocessor within the housing. The microprocessor is located in the housing so as to control the illumination of the push buttons by light sources located below the top surface of the housing and to control the emission of distinct tones by a loudspeaker during the play of the games. Certain of the games require the participant or participants to repeat nonrepetitive and ever lengthening sequence of tones and lights by properly operating the push buttons. Other of the games require the participants to actuate the push buttons as they are illuminated by the microprocessor.

31 Claims, 7 Drawing Figures

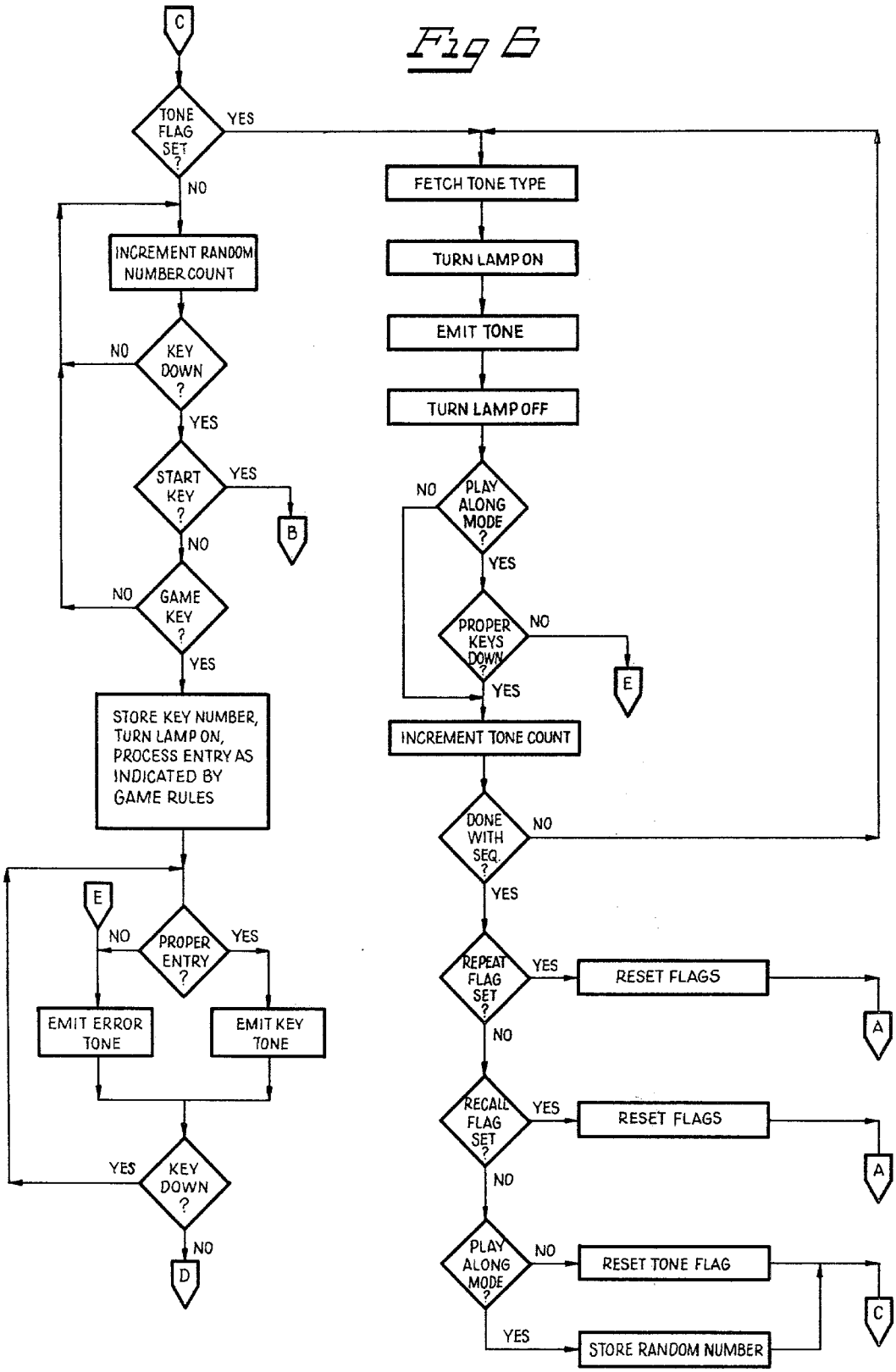
Fig 6
C
TONE FLAG SET ?
YES
NO
INCREMENT RANDOM NUMBER COUNT
KEY DOWN ?
NO
YES
START KEY ?
YES
B
NO
GAME KEY ?
NO
YES
STORE KEY NUMBER, TURN LAMP ON, PROCESS ENTRY AS INDICATED BY GAME RULES
E
PROPER ENTRY ?
NO
YES
EMIT ERROR TONE
EMIT KEY TONE
KEY DOWN ?
YES
NO
D
FETCH TONE TYPE
TURN LAMP ON
EMIT TONE
TURN LAMP OFF
PLAY ALONG MODE ?
NO
YES
PROPER KEYS DOWN ?
NO
E
YES
INCREMENT TONE COUNT
DONE WITH SEQ. ?
NO
YES
REPEAT FLAG SET ?
YES
RESET FLAGS
A
NO
RECALL FLAG SET ?
YES
RESET FLAGS
A
NO
PLAY ALONG MODE ?
NO
RESET TONE FLAG
C
YES
STORE RANDOM NUMBER

MICROCOMPUTER CONTROLLED GAME

BACKGROUND OF THE INVENTION

1. Field Of The Invention

This invention relates generally to games, and more particularly, to an electronic board game which utilizes audible and visual indications in connection with the play of the game and in connection with advising a participant or participants of the state or progress of the game being played.

2. Description Of The Prior Art

In recent years microprocessors have become more widely available and various electronic board games have been devised utilizing such microprocessors. One such game is disclosed in United States patent application Ser. No. 834,643 assigned to the assignee of record of the present application now U.S. Pat. No. 4,207,087. In addition, other games have been devised such as the other games referred to or cited in that application including the "Touch Me" game manufactured by Atari, Inc. and disclosed in the "Touch Me" Operating and Maintenance Manual of Atari, Inc., dated 1974.

SUMMARY OF THE INVENTION

Accordingly, it is an object of the present invention to provide an electronic board game having different games which can be played by one participant verses the board game, by a number of participants against the board game or between two participants.

It is another object of the present invention to provide an electronic board game that tests the oral and visual memory of a participant or participants.

It is a further object of the present invention to provide an electronic board game which provides a keyboard type device that requires a participant to repeat varying sequences of events, the events being a combination of audible and visual indications with the sequence of events being randomly changed and the length of the sequence of events being progressively lengthened.

It is yet another object of the invention to provide an electronic board game which is controlled by a microprocessor so that the board game can be programmed to play a variety of games involving varying numbers of participants.

Another object of the present invention is to provide an electronic board game having a new and improved keyboard configuration which enables various participants to play the game at any one time, which enables the board game to distinguish between different players playing the game, and which enables two players or participants to play against each other and the board game to announce or indicate the winner of the game.

It is yet another object of the present invention to provide an electronic board game that allows participants to have repeated the longest or last sequence of events which has been generated by the board game.

It is yet another object of the present invention to provide an electronic board game wherein the participants may selectively vary the speed at which a game is to be played and vary the skill level at which a game is to be played.

It is still another object of the present invention to provide an electronic board game in which players can select certain games to be played simultaneously by two players against each other.

In accordance with these and many other objects of the present invention, an embodiment of the present invention comprises an electronic board game having a keyboard which is subdivided into a plurality of playing areas, each of which areas includes two manually operable actuators or push buttons. The board game utilizes a microprocessor to generate tones and lights, each of which tones and lights are associated with one of the playing areas on the keyboard. Since one of the push buttons for each playing area is located on one side of the housing and the other of the push buttons for each playing area is located on the other side of the housing, more than one player can play games on the electronic board game at any one time. In addition, certain of the games can be played on the electronic board game by two players playing against each other on opposite sides of the housing with the electronic board game announcing the winner of the game. The housing has disposed thereon various controls to permit the selection of the game to be played, the selection of the skill required to win the game and the selection of the speed at which the game is to be played, and also to have the game repeat the last or longest sequence generated or to have the game announce the winner of the game when played between two players in a play-along mode.

The microprocessor utilized in the electronic board game can be programmed to permit players or participants to play various different games on the electronic board game. In certain of these games a participant or participants must repeat a particular sequence of events, comprising tones and associated lights illuminating the playing areas, by depressing the push buttons in the playing areas in the order in which the push buttons were illuminated by the electronic board game. The generation of the sequence of tones and lights by the microprocessor is at random and when a sequence is correctly repeated the next sequence is a different one, but it includes an additional event. In other games participants have to respond to the illumination of the playing areas as they are illuminated by the electronic board game and these games can be played between players in a play-along mode.

DESCRIPTION OF THE DRAWINGS

These and other objects and advantages of the present invention will become more apparent by reference to the following description taken in conjunction with the accompanying drawings wherein:

FIGS. 5–7 are logical flow charts illustrating the functions performed by the microprocessor controlling the operation of the game according to the present invention.

DETAILED DESCRIPTION OF THE PREFERRED EMBODIMENT

Figure 1:
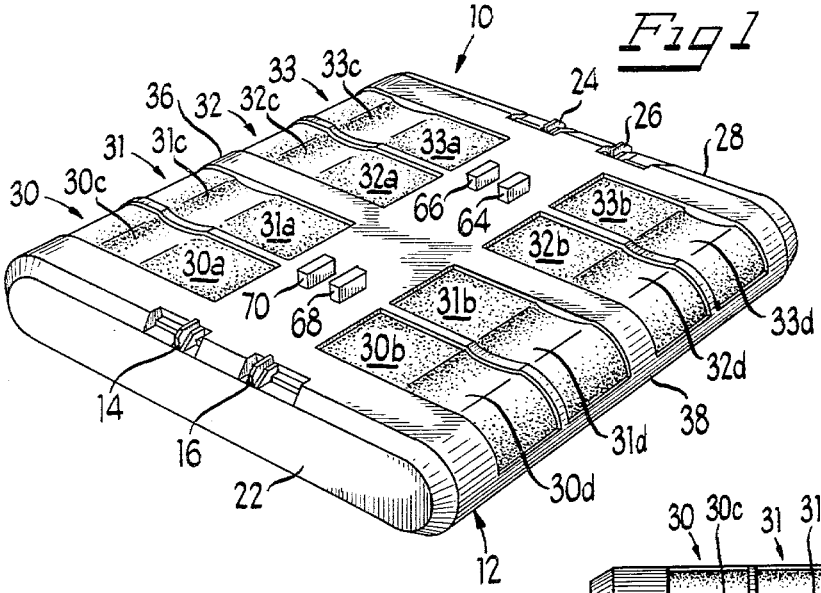
FIG. 1 is a perspective view of the preferred embodiment of the device according to the invention.
Figure 2:
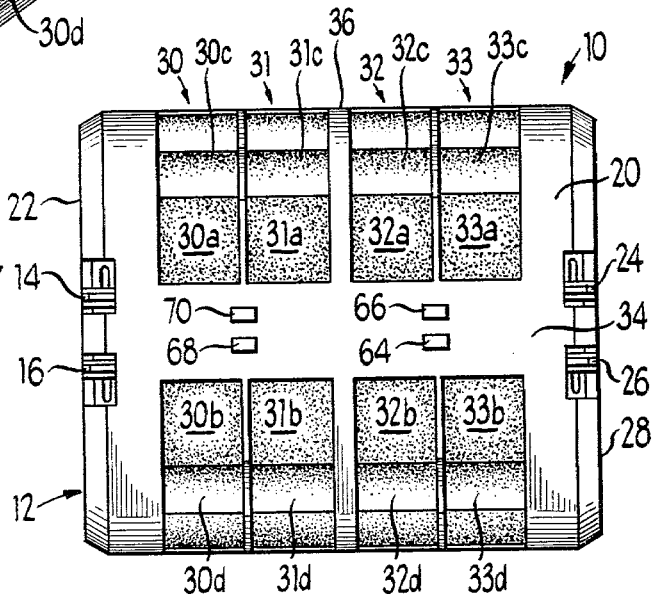
FIG. 2 is a top view of the device shown in FIG. 1.

Referring now more specifically to FIGS. 1 and 2 of the drawings, therein is shown an embodiment of the electronic board game which embodies the present invention and which is generally designated by the numeral 10. The electronic board game 10 includes a generally rectangular housing 12 on which and in which is disposed all of the control apparatus for the play of the electronic board gam 10. An on/off switch 14 and a speed control switch 16 are disposed on the top surface 20 of the housing 12 along one edge 22 of the housing 12. A game select switch 24 and a skill select switch 26 are located on the top surface 22 of the housing 12 along an opposite edge 28 of the housing 12. The on/off switch 14 is a two position switch controlling the energization of the electronic board game 10 by a battery or the like. The game select switch 24 allows a particpant of the electronic board game 10 to select which of a number of games (five such games are described hereinafter) is to be played on the electronic board game 10. The switches 16 and 26 in effect determine the skill level that is required of the player playing the selected game; the switch 16 controlling the speed at which the game is played and the switch 26 controlling how long of a sequence must be attained before a participant can win a particular game. In addition, and as explained in more detail below, with certain of the games which can be played on the electronic board game 10, the skill selector switch 26 also is used to determine if the game is to be played in a duplicate or play-along mode.

The central portion of the top surface 20 of the housing 12 is subdivided into four control or play areas 30, 31, 32 and 33. Each of these play areas 30, 31, 32 and 33 contains two manually operable push buttons **30*a* and 30*b*, 31*a* and 31*b*, 32*a* and 32*b* and 33*a* and 33*b*, respectively. Each of the push buttons 30*a*, 31*a*, 32*a* and 33*a* is connected to a central panel 34 in the top surface 20 of the housing 12 so that the push buttons 30*a*, 31*a*, 32*a* and 33*a* act as a cantilever which can be depressed by a participant along an edge 36 of the housing 12. Similarly, the push buttons 30*b*, 31*b*, 32*b* and 33*b* are connected to the central panel 34 such that each of the push buttons 30*b*, 31*b*, 32*b* and 33*b* is in the form of a cantilever which can be depressed by a participant along an edge 38 of the housing 12. In order to make it more easy for a player to depress the push buttons 30*a*, 30*b*, 31*a*, 31*b*, 32*a*, 32*b*, 33*a* and 33*b*, during the play of a game, the push buttons 30*a*, 30*b*, 31*a*, 31*b*, 32*a*, 32*b*, 33*a* and 33*b* respectively have recesses or valleys 30*c*, 30*d*, 31*c*, 31*d*, 32*c*, 32*d*, 33*c* and 33*d***.

The push buttons **30*a*, 30*b*, 31*a*, 31*b*, 32*a*, 32*b*, 33*a* and 33*b* control the progress of the games by opening and closing switches located in the housing 12. More specifically, and with reference to FIGS. 1, 2 and 4 of the drawings, the depression of the push button 30*a* closes a normally open contact switch 40, the depression of the push button 30*b* closes a normally open contact switch 42, the depression of the push button 31*a* closes a normally open contact switch 44, the depression of the push button 31*b* closes a normally open contact switch 46, the depression of the push button 32*a* closes a normally open contact switch 48, the depression of the push button 32*b* closes a normally open contact switch 50, the depression of the push button 33*a* closes a normally open contact switch 52 and the depression of the push button 33*b* closes a normally open contact switch 54. Consequently, the depression of any of the push buttons in the playing areas 30–33 can be detected by the electronic circuitry disposed in the housing 12**.

Each of the push buttons **30*a*, 30*b*, 31*a*, 31*b*, 32*a*, 32*b*, 33*a* and 33*b* is generally translucent so that lights or lamps may be positioned within the housing 12 below the top surface 20 to illuminate the playing areas 30–33. In particular, a light diagrammatically shown in FIG. 4 as light 56 is positioned below the playing area 30, a light 58 is positioned below the playing area 31, a light 60 is positioned below the playing area 32 and a light 62 is positioned below the playing area 33. Alternately, a light can be positioned below each of the push buttons in the playing areas 30–33 with the two lights below each playing area 30–33 being connected in parallel so as to still illuminate the entire playing area at any given time. In order to make each playing area 30–33 more distinctive, the push buttons in each of the playing areas 30–33 can be made of a different color. For instance, the push buttons 30*a* and 30*b* in playing area 30 may be made of a red translucent material, the push buttons 31*a* and 31*b* in the playing area 31 may be made of a blue translucent material, the push buttons 32*a* and 32*b* in the playing area 32 may be made of a green translucent material and the push buttons 33*a* and 33*b* in the playing area 33** may be made of a yellow translucent material.

The electronic board game 10 also has a loudspeaker 63 which is used to emit various tones during the play of the games which can be played on the electronic board game 10. Each time one of the playing areas 30–33 is illuminated a tone associated with that playing area is also emitted from the loudspeaker 63. In addition, another tone is emitted from the loudspeaker 63 to signify when an error has been made by a player, and yet another tone is emitted to signify when a player has won a game.

The configuration of the electronic board game 10 and particularly the dividing of the central portions into the playing areas 30–33 with one set of push buttons **30*a*, 31*a*, 32*a* and 33*a* on one side of the central panel 34 and another set of push buttons 30*b*, 31*b*, 32*b* and 33*b* on the other side of the central panel 34 enables two players to play various ones of the games played on the electronic board game 10 against each other and at the same time in what is referred to with respect to games 4 and 5 below as a duplicate game or play-along mode. Moreover, since each of the push buttons 30*a*, 30*b*, 31*a*, 31*b*, 32*a*, 32*b*, 33*a* and 33*b* actuate or control separate switches 40, 42, 44, 46, 48, 50, 52 and 54, respectively, the winner of these play-along games can be determined by the electronic board game 10. In addition, the provision of two push buttons for each playing area 30–33 enables a number of players to more easily participate in the play of other of the games played on the electronic board game 10**.

Figure 4:
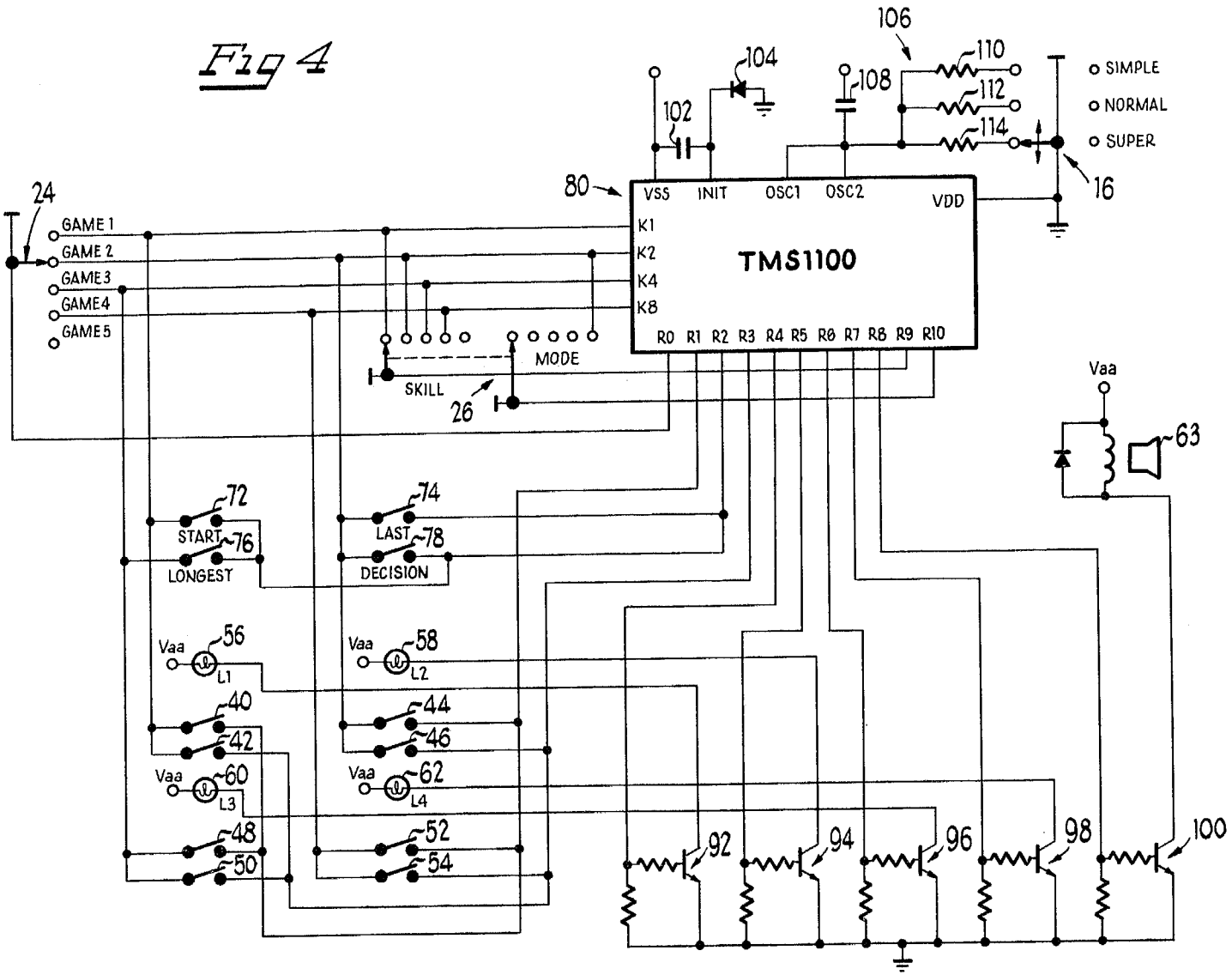
FIG. 4 is a detailed schematic diagram of the electronic circuitry of the game according to the present invention.

There also are other controls located on the central panel 34 for the operation of the electronic board game 10. Push buttons 64, 66, 68 and 70 on the control panel 34 control respectively normally open switches 72, 74, 76 and 78 (FIG. 4 of the drawings). The push button 64 is depressed to initiate the start of any one of the games which can be played on the electronic board game 10, the push button 66 is depressed when a player wants to have repeated the last sequence of tones and lights generated by the electronic board game 10, the push button 68 is depressed to have the electronic board game 10 repeat the longest sequence of tones and lights which has been generated during a given energization of the electronic board game 10 and the push button 70 is depressed when the players want the electronic board game 10 to announce the winner of one of the play-along mode types of games (for instance, games 4 and 5 described below).

In this regard, the configuration of the electronic board game 10 permits the decision as to a winner of a game to be announced. This is because certain ones of the playing areas may be lit to announce the winner, i.e. the player playing on the side 36 of the housing 12 or on the side 38 of the housing 12. For example, if both of the participants playing on the sides 36 and 38 of the housing 12 tie, then the playing area 30 may be illuminated. If both of the participants on the sides 36 and 38 lose, then the playing area 33 may be illuminated. On the other hand, if the participant on the side 36 of the housing 12 is the winner, then the playing area 32 may be illuminated and finally if the participant on the side 38 of the housing 12 wins then the playing area 31 may be illuminated.

As indicated above, several games may be played by using the electronic board game 10. These games are selected by appropriately positioning the game select switch 24. Five such games are described below, however a microprocessor 80 shown diagrammatically in FIGS. 3 and 4 of the drawings also described below may be programmed to play other games.

Game 1

This game is played between a participant and the electronic board game 10. Upon depression of the start of game switch 64 by a participant, the microprocessor 80 will cause one of four notes contained in its memory to be sounded, and will cause one of the four indicator lights 56, 58, 60 or 62 associated with that particular tone to be energized so as to illuminate the corresponding play area 30–33, respectively. The player or participant must now depress either of the push buttons in the illuminated play area. If the participant presses one of the push buttons in the correct previously illuminated play area, the electronic board game 10 then generates a new sequence of tones and associated illuminated play areas. The new sequence in one additional tone and an associated light longer than the previous sequence. However, the first sequence of tones and the associated lights will not be repeated, so that each sequence will be entirely different and one event (i.e. a tone and its associated light) longer than the preceeding sequence. The game continues with the participant attempting to repeat the new sequence of tones and lights generated by the electronic board game 10, again with each sequence of tones and lights being entirely different from and one tone and light longer than the previous sequence.

At the first occurrence of an erroneous key entry by the participant attempting to repeat the previous sequence, the microprocessor 80 causes a distinctive error signal to be sounded by the loudspeaker 63. This concludes the game sequence. Alternately, the game is ended when the participant has correctly entered all of the sequence of events, the length of which has been selected by the skill selector switch 26. For example, the length of such sequences may be selected to be six events long, ten events long, fourteen events long or thirty-one events long. The microprocessor 80 may be programmed to have the loudspeaker 63 generate a second distinctive win signal when the participant has correctly repeated the entire sequence of events as selected by the skill selector switch 26.

The speed of the game, or in other words the speed at which the tones and lights will be generated, can be controlled by the selector switch 16. For instance, a relatively slow speed may be utilized for beginners or those players who are not very astute at the particular game, a slightly faster speed will be used for those players who require a greater challenge when playing the game, and an even faster speed will be used by those players who require the most challenge when playing the game.

After the conclusion of the game sequence, either because of an erroneous key entry or because the participant has correctly repeated the longest sequence possible, the participant has the option of starting a new game by depressing the push button 64 or the participant can review the previously keyed in tone and light sequence by pushing the last game review button 66. Upon depressing the push button 66, the microprocessor 80 will automatically repeat the last sequence of tones and associated lights which had been generated up to that point in the game. In addition, the longest sequence which has been generated by the electronic board game 10 since the start of play (i.e. the turning on of the switch 14) can be reviewed by depressing the push button 68.

Game 2

As is the case with the other games, game 2 is selected by appropriately positioning the selector switch 24 located along the edge 28 of the housing 12. Two to four players may take part in this game. Each of the players is assigned one or more of the play areas 30–33. In the case of two players, each player is assigned two of the play areas 30–33, whereas when four players are playing, each player is assigned one of the play areas 30–33. The game starts by the electronic board game 10 generating a given tone and light associated with one of the play areas 30–33. The player who is assigned to that play area must depress one of the push buttons in that particular play area. If either of the push buttons in the proper play area is depressed, then the electronic board game 10 generates another sequence of tones and corresponding lights which is one tone and light longer than the first sequence of events, but which is not a repetition of the previous sequence of events. The given player or players who have been assigned the particular play areas that have been illuminated during this next sequence of events must sequentially depress the push buttons in the play areas 30–33 in the same sequence that the electronic board game 10 has illuminated these play areas. The game continues with each new sequence of events being increased by an additional event of a tone and associated light with the participants properly depressing either of the push buttons in their assigned play areas in the same order that the sequence of events was generated by the electronic board game 10.

As each player misses the assigned sequential depression of a push button, the play area to which that player was assigned is no longer included in the next sequence of events that is generated by the electronic board game 10 and the player is eliminated when all of that player's play areas are eliminated from the next sequence. The game continues until all of the participants except one are eliminated from the game or the longest sequence of events selected by the skill select switch 26 has been generated by the electronic board game 10. Once again, the last or longest sequence of events may be reviewed by the depression of the push button switch 66 for the last sequence of events and the push button switch 68 for the longest sequence of events.

Game 3

This game also can be played by two to four players. Each of the players chooses one of the playing areas 30–33 to signify his or her playing position. Since each of the play areas 30–33 are a specific color, this entails each of the players picking a particular color to signify his or her playing position. The electronic board game 10 then generates a test sequence of tones and associated lights which all of the players observe. After this test sequence has terminated, a commutating sequence which includes the illumination of all of the play areas 30–33 and is accompanied by the proper tones is generated and commutates for a desired period of time; for example five seconds. This commutating sequence then stops abruptly, leaving one of the playing areas 30–33 lit for a very short period of time; for example 0.5 seconds. The play area that remains lit with its accompanying proper tone for this short period of time signifies to the player who has picked that play area that it is that player's turn. The appointed player then must repeat the entire test sequence that has been previously generated by the electronic board game 10 by depressing in sequence the push button in the play areas.

If that player is successful in repeating the test sequence, the original test sequence is played again, but this time the test sequence has an additional event, or in other words, has an additional tone and associated light. Thereafter the commutating sequence is played again, selecting another player at random to respond to the test sequence by repeating the test sequence. When a player makes an error in repeating the test sequence, an error signal or raspberry type tone is generated by the electronic board game 10 through the loudspeaker 63 to signify that that player has been eliminated from the play of the game. The color or play area 30–33 which the player had chosen is eliminated from the subsequent commutating sequences. The play of the game continues until all players but one are eliminated and the remaining player is declared the winner of the game or until the test sequence is at least as long as that set by the skill selector switch 26.

Game 4

In this game a single player can play against the electronic board game 10 or two players may play the game against each other in a duplicate or play-along mode. If one player is playing the game, the game select switch 24 is positioned to select game four and the skill level of the game is also selected by the proper positioning of the skill selector switch 26. A sequence of one tone and its associated light is generated by the electronic board game 10 and this sequence is repeated twice. On the second repetition of this sequence the player must depress one of the push buttons in the play are illuminated by the electronic board game 10. If the player is successful the electronic board game 10 then generates a two tone and associated light sequence. As before, the player during the second repetition of this sequence must depress the push buttons in the proper play areas 30–33 in step with the generation of the sequence by the electronic board game 10. Each time the player is successful in repeating the sequence in step with the electronic board game 10 the electronic board game 10 generates the same sequence but adds an additional tone and associated light to the sequence. The player wins the game if he or she is able to properly repeat in step with the board game 10 a sequence of the length set by the skill level switch 26.

As previously indicated, this game can be played between two players. In order to do this the skill level switch 26 is set to a duplicate mode position. When the board game 10 repeats a sequence a second time each of the players attempt to repeat the sequence in step with the board game 10. The configuration of the board game 10 enables this to be done because one of the players may depress the push buttons 30*a*, 31*a*, and 33*a* along the side 36 of the housing 12 and the other player may be positioned along the side 38 of the housing 12 and depresses the push buttons 30*b*, 31*b*, 32*b* and 33*b*. Since the push buttons 30*a*, 30*b*,31*a*, 31*b*, 32*a*, 32*b*, 33*a* and 33*b* individually control respectively key switches 40, 42, 44, 46, 48, 50, 52 and 54 of the board game 10, the machine can determine which one of the players makes an error during the play of the game.

The play of the game continues between the players with the sequence being one event longer each time both of the players properly repeat the sequence in step with the board game 10 on the second repetition of the sequence. Finally, when one or both of the players make a mistake so that an erroneous key entry is made, an error tone is emitted and the game is terminated. The decision button 70 is then depressed and the electronic board game 10 indicates the results of the game by illuminating one of the play areas 30–33 as heretofor described.

Game 5

This game can be played between one player and the electronic board game 10 or between opposing players. The game is selected by the game select switch 24 and as long as skill switch 26 is not set in the duplicate play mode the skill level is set for a 31 event sequence. The game starts by depressing the start button 64 and the board game 10 illuminates a play area and emits the proper corresponding tone. The player must respond by depressing one of the push buttons in the particular play area 30–33 that has been illuminated while it is still illuminated. If the player is correctly responding, another one of the play areas 30–33 or the same play area is illuminated and its associated tone emitted. The game so continues as long as the player correctly responds. However, the length of time that the play areas are illuminated becomes increasingly shorter as the game proceeds such that the rate the player must respond increases steadily. If the player does not respond to the illuminated play area in time, an error signal tone is emitted and the game is over. When the play of the game is over, the player may depress the last button 64 and the entire sequence that was emitted before the error is played back so that a player may count the number of steps to which he properly responded.

On the other hand, the game can be played between two players, one along the side 36 and the other along the side 38, by selecting the duplicate play mode on the selector switch 26. In this play of the game each of the players responds to the illuminated play areas simultaneously and the time of illumination also becomes steadily shorter. The game only ends when one of the players makes an error. At this time, the decision button 70 can be depressed with the electronic board game 10 signifying which of the players has won the game. A new game can then be initiated by depressing the start button 64.

The above described games have been given by way of example only, and the number of possible games is limited only by the capability of the microprocessor 80 within the electronic board game 10 and the ingenuity of the programmer of the microprocessor 80. The number of games that may be played is considerably greater than the five examples given heretofor.

Figure 3:
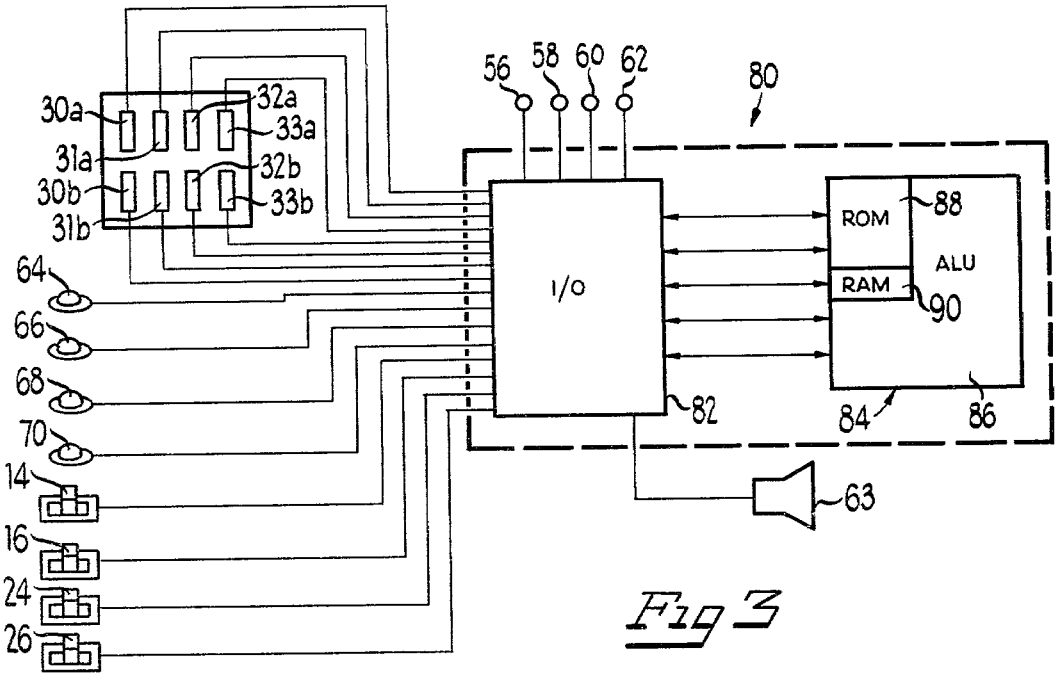
FIG. 3 is a block diagram of the electrical components of the game according to the invention.

Referring now to FIG. 3 of the drawings, the microprocessor 80 used in the electronic board game 10 has an input/output section 82 connecting the switches 40, 42, 44, 46, 48, 50, 52 and 54 controlled respectively by the manually operated push buttons 30*a*, 30*b*, 31*a*, 31*b*, 32*a*, 32*b*, 33*a* and 33*b* in the playing areas 30–33, the switches 72, 74, 76 and 78 controlled respectively by manually operable push buttons 64, 66, 68 and 70, and the manually operable selector switches 14, 16, 24 and 26 to a computing device 84 having an arithmetic logic unit 86, a read only memory 88 and a random access memory 90. The arithmetic logic unit 86 processes the inputs received from the various input devices in accordance with the game selected from the read only memory 88 by the selector switch 24 and serves to operate the loudspeaker 63 and the four lights 56, 58, 60 and 62, which are associated with the respective one of the play areas 30–33, in accordance with the rules of the game selected. Thus, while one of the games stored in the read only memory 88 is selected by the game select switch 24, the arithmetic logic unit 86 operates on the input from the play areas 30–33 and particularly the switches 40, 42, 44, 46, 48, 50, 52 and 54 to perform the necessary arithmetic logic steps and to store the necessary data, such as the length of the last sequence, into the random access memory 90. The arithmetic logic unit 86 also serves to provide the necessary responses to the participant by appropriately energizing the lights 56, 58, 60 and 62 and sounding the appropriate tone including an error tone through the loudspeaker 63.

Referring now to FIG. 4 of the drawings, the housing 12 of the electronic board game 10 includes the microprocessor 80, as illustrated in conjunction with FIG. 3 of the drawings, and it can be implemented utilizing a single chip large scale integrated microprocessor as the main computing device. A TMS 1100 single chip microprocessor manufactured by Texas Instruments, Inc. is suitable for use as the microprocessor 80 and the chip contains the input/output circuitry 82 and the computing device 84 illustrated in FIG. 3 of the drawings. Driver transistors 92, 94, 96, 98 and 100 serve as a part of the input/output circuitry 82 and are driven by the outputs of the microprocessor 80 and serve to drive or energize the lights 56, 58, 60 and 62 and the loudspeaker 63.

A time delay circuit comprising a capacitor 102 and a diode 104 serves to reset and initiate the operation of the microprocessor 80 each time the power is turned on and off by the on/off switch 14. A timing circuit generally designated as 106 controls the operation of the internal clock of the microprocessor 80. The timing circuit 106 includes a capacitor 108 and three resistors 110, 112 and 114. The speed selector switch 16 determines which of the resistors 110, 112, 114 is to be utilized at any given time in the timing circuit 106. For instance, the resistor 110 can be of an ohmic value so that when it is utilized in the timing circuit 106 the internal clock of the microprocessor 80 will be slightly slower and the play of the electronic board game 10 will be slow enough for those players that are not very astute at playing a game. Likewise, the value of the resistors 112 and 114 can be selected so that when the resistor 112 is utilized in the timing circuit 106 the internal clock of the microprocessor 80 is slightly faster than when the resistor 110 is utilized and so that when the resistor 114 is used the clock for the microprocessor 80 is even faster, resulting in the games of the electronic board game 10 being played even faster and providing a player a greater challenge.

As is shown in FIG. 4 of the drawings, the microprocessor 80 has a plurality of outputs designated as R0–R10 and a plurality of inputs designated as K1, K2, K4 and K8. The output R0 can be coupled to one of the inputs K1, K2, K4 or K8 through the game selector switch 24 so that the microprocessor 80 can determine which game has been selected. The outputs R1, R2 and R3 can similarly be coupled to one of the inputs K1, K2, K4 or K8 through various ones of the key switches 40, 42, 44, 46, 48, 50, 52, 54, 72, 74, 76, 78 so that the microprocessor 80 can determine when any one of those switches are closed. The outputs R4, R5, R6 and R7 are coupled respectively to the driver transistors 92, 94, 96 and 98 for the energization of the lights 56, 58, 60 and 62 and the output R8 is coupled to the driver transistor 100 that controls the loudspeaker 63. The output R9 can be coupled to one of the inputs K1, K2, K4 or K8 through the skill selector switch 26 and the output R10 can be coupled to the input K2 when the skill selector switch 26 is placed in its duplicate or play-along mode. By so connecting the inputs and outputs of the microprocessor 80, the microprocessor 80 monitors the state of the control switches 72, 74, 76 and 78, the game selector switch 24, the skill level selector switch 26 and the play switches 40, 42, 44, 46, 48, 50, 52 and 54 by sequentially energizing its outputs R0–R3 and R9–R10 while monitoring its inputs K1, K2, K4 and K8.

More specifically, when the output R0 is energized the microprocessor 80 can determine the position of the game selector switch 24 by monitoring the inputs K1, K2, K4 and K8. If none of the inputs are energized, the game selector switch 24 is selecting the fifth game. Similarly, the microprocessor 80 can determine which of the switches 44, 52, 48 and 40 are closed by energizing the output R1 and monitoring the inputs K2, K8, K4 and K1; the microprocessor 80 can determine the state of the switches 74, 78, 72 and 76 by energizing the output R2 and monitoring the inputs K2, K1 and K4; and the microprocessor 80 can determine the position of the skill selector switch 26 by energizing the output R9 and monitoring the inputs K1, K2, K4 and K8, or determine whether the skill selector switch 26 is in the duplicate play mode by energizing the output R10 and monitoring the input K2. The outputs R4–R7 are utilized to drive the driver transistors 92, 94, 96 and 98 which respectively energize in response to the energization of the outputs R4–R7, the lights 56, 58, 60 and 62. The output R8 in a similar manner drives the output transistor 100 which controls the loudspeaker 63.

Figure 7:
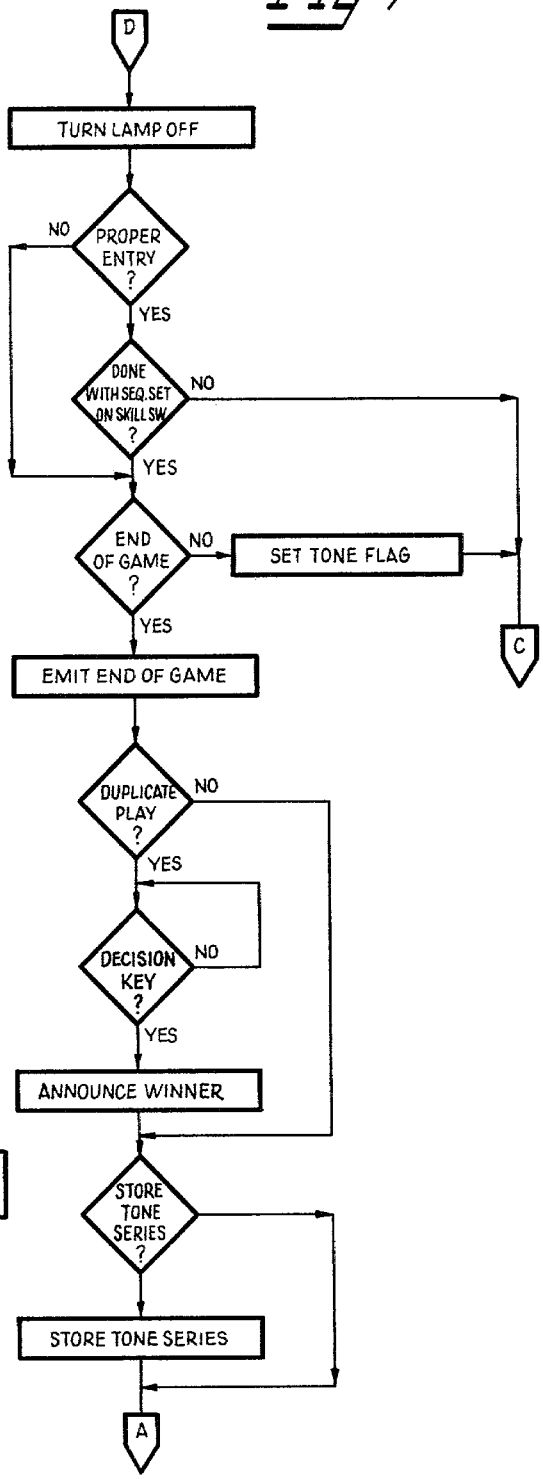

The microprocessor 80 is readily programmed in a manner described in the TMS 1000 Series Data Manual published in December, 1975 by Texas Instruments, Inc. to perform the functions necessary to play the desired games. Flow charts illustrating the programming of the microprocessor 80 for the games particularly described heretofor are illustrated in FIGS. 5–7 of the drawings.

Figure 5:
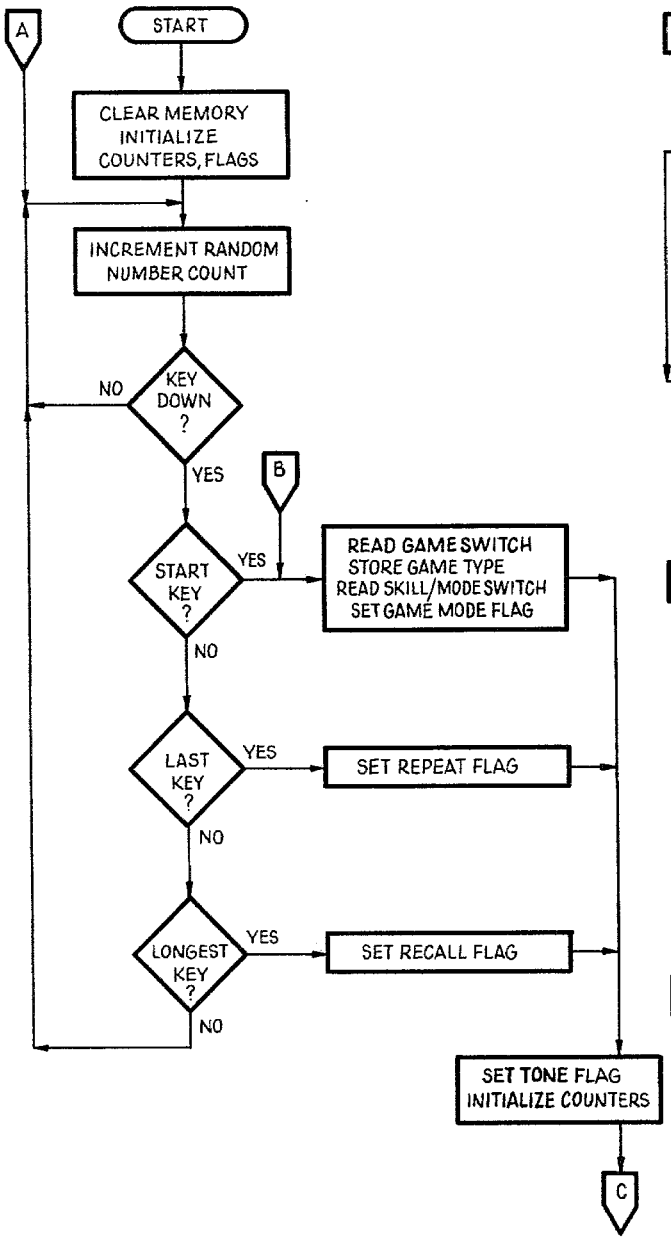

Referring now more specifically to FIG. 5 of the drawings, when the on/off switch 14 turns on the electronic board game 10 the memory of the microprocessor 80 is cleared and the random number count is incremented. A determination is then made whether any of the push buttons 64, 66 or 68 is depressed. If none are, the random number count is continuously incremented. If one of these push buttons 64, 66 or 68 is depressed, a determination is then made as to which of these push buttons have been depressed. If the start push button 64 has been depressed, the microprocessor 80 reads the position of the game select switch 24, the skill mode select switch 26 and sets the game mode flag so as to select the board game corresponding to the position of the game select switch 24 and the skill switch 26. If the last sequence push button 66 or the longest push button 68 has been depressed, the appropriate repeat or recall flag is set. In any event, the tone flag is set and the counters are initialized.

Assuming that the start key 64 has been depressed, causing the appropriate game and skill level to be stored, the setting of the tone flag causes a particular tone to be fetched (right-hand side in FIG. 6). One of the lamps 56, 58, 60 or 62 is then turned on and a tone is emitted followed by the lamp being turned off. A determination is then made whether the skill mode switch 26 is in the play-along or duplicate mode. If not, the tone count is incremented and a determination is made whether the sequence of tones and lights has been completed, whether the repeat flag has been set, whether the recall flag has been set, and whether the skill level mode switch 26 is in the duplicate play-along mode. Assuming that the selector switch 26 has not been set for the play-along mode, the tone flag is reset and the game is continued in accordance with the rules of the game as stored in the microprocessor 80. The particular game is played generally as shown in the left-hand portion of FIG. 6. As long as proper entries are made, the play of the game continues. However, if a player makes an error, an error tone is emitted and in accordance with the flow chart in FIG. 7 of the drawings, a decision is made as to whether the game has ended. If it has ended, an end of game tone is emitted and as long as the skill mode selector switch 26 is not in the play-along mode, the sequence of tones is stored and the game is again ready to be played or a new game can be played in accordance wih the flow charts in FIGS. 5–7. On the other hand, if the determination is made that the game is not ended, play of the game continues in accordance with the flow charts of FIGS. 6 and 7.

In the event that one of the games is being played in the duplicate or play-along mode, once the tone type is fetched in accordance with the right-hand side of FIG. 6, a determination is then made that the game is being played in a duplicate or play-along mode. As long as the proper keys are depressed in the playing areas 30–33 the tone count is incremented and the play of the game continues until an improper push button in the playing areas 30–33 is depressed by one of the players. When it is determined that an error has been made, an error tone is emitted and the game is ended. Since the game is being played in the duplicate or play-along mode, a determination is made whether the decision push button 70 has been depressed, and if it has, the winner is announced by lighting one of the playing areas 30–33.

It should be understood that numerous modifications of the invention described herein can be devised by those skilled in the art that fall within the spirit and scope of the principals of this invention, even if the invention is not practiced as specifically described herein.

What is claimed and desired to be secured by the Letters Patent of the United States is:

1. A sequencing game comprising:

means for generating a sensorially perceptible time sequence of events, said sequence generating means including means for generating a plurality of distinct sensorially perceptible events in a predetermined time sequence and at a predetermined time rate;

means actuable by a participant for responding to said time sequence of events;

means coupled to said time sequence generating means and to said participant actuable means for determining the correctness of the participant's response, said correctness determining means providing a first indication when said participant actuable means are actuated in a predetermined sequence corresponding to the sequence generated by said time sequence generating means and for providing a second indication when said participant actuable means are actuated in a time sequence other than said predetermined time sequence; and means responsive to said second indication for generating an error signal and to said first indication for having said time sequence generating means generate another different subsequent time sequence of events, said another time sequence of events being one event longer than said previous time sequence of events.

2. The sequencing game as set forth in claim 1 including manually operable means to control the predetermined time rate.

3. The sequencing game as set forth in claim 1 wherein said correctness determining means includes means for storing a representation of the time sequence generated by said time sequence generating means and means for comparing the stored representation of the time sequences generated by said time sequence generating means with the time sequence generated by said participant actuable means and including means coupled to said representation storing means to provide a repetition of the last generated sequence generated by said time sequence generating means that was followed by a correct participant response.

4. The sequencing game as set forth in claim 1 wherein said participant actuable means includes a plurality of manually operable control means, each associated with a single one of said distinct sensorially perceptible events and actuable by the participant in response to one of said distinct events.

5. The sequencing game as set forth in claim 4 wherein each of said manually operable control means includes two manually operable means, each of which manually operable means being separately operable by a participant.

6. The sequencing game as set forth in claim 4 wherein said correctness determining means includes deleting means for deleting from any subsequent time sequence of events to be generated by said time sequence generating means the distinct event associated with an improperly operated one of said manually operable control means.

7. The sequencing game as set forth in claim 1 including participant selecting means for generating a participant selecting sensorially perceptible time sequence of events, said participant selecting means generating said participant selecting time sequence of events for a first predetermined period of time following each time sequence of events being generated by said time sequencing generating means and maintaining for a second predetermined period of time sensorially perceptible the last generated event in said participant selecting time sequence of events.

8. The sequencing game as set forth in claim 7 wherein said participant selecting means includes participant deleting means for deleting from any participant selecting time sequence of events any event associated with a participant who has not properly actuated said participant actuable means.

9. The sequencing game as set forth in claim 1 wherein said time sequence generating means generates twice each of said time sequence of events and wherein said correctness determing means provides said first indication when said participant actuable means are actuated in step with said second repetition of said time sequence of events and provides said second indication when said participant actuable means are not actuated in step with said second repetition of said time sequence of events.

10. The sequencing game as set forth in claim 9 wherein said participant actuable means includes two manually operable means, each of which is operable by a different participant and wherein said correctness determining means includes means to detect which of said operable means has not been actuated in step with said second repetition of said time sequence of events when said correctness determining means provides said second indication.

11. A sequencing game device comprising:

a housing;

a microprocessor disposed within said housing;

a plurality of manually operable means affixed to said housing, each manually operable means being individually operable by a player;

means within said microprocessor for generating at a randomly varying rate a sensorially perceptible time sequence of distinct, serially occurring events individually and in a random time sequence, with each distinct event being associated with a single corresponding one of said manually operable means; and means within said microprocessor operatively coupled to said manually operable means and to said sequence generating means for comparing the time sequence of events generated by the sequence generating means with a manually entered time sequence of events generated by individual and sequential operation of said manually operable means, said comparing means being operative to provide an error signal when an event of said manually entered sequence generated by an improper operation of one of said manually operable means does not correspond to a corresponding event of the sequence generated by said sequence generating means, and said comparing means providing a continuing indication when said manually entered sequence corresponds to the sequence generated by said sequence generating means to cause said sequence generating means to generate another sensorially perceptible time sequence of distinct serially occurring events individually and in a random time sequence, said another time sequence of events being one event longer than the previously generated time sequence of events.

12. The sequencing game of claim 11 including:

a plurality of light sources affixed to said housing, each of said light sources being associated with a single one of said manually operable means and illuminated upon manual operation of the associated manually operable means;

means within said microprocessor for generating a plurality of distinct tone frequencies, each of said distinct tone frequencies being individually associated with one of said manually operable means and being individually generated upon the manual operation of said associated manually operable means, said tone generating means further including means for generating an error tone; and transducer means coupled to said tone frequency generating means for generating a distinct audible tone in response to each of said distinct tone frequencies and in response to said error tone.

13. The sequencing game as set forth in claim 11 wherein each of said manually operable means includes two actuator means, one of said actuator means being on one side of said housing and the other of said actuator means being on the other side of said housing, said microprocessor having actuator determining means to determine which of said actuator means has been manually operated.

14. A sequencing game device as set forth in claim 11 wherein said comparing means includes means for deleting from each sequence generated by said time sequence generating means each distinct event associated with an improperly operated one of said manually operable means.

15. A sequencing game comprising:

means for generating a first sensorially perceptible time sequence of events, said first sequence generating means including means for generating a plurality of distinct sensorially perceptible events in a predetermined time sequence and at a predetermined time rate;

means actuable by a participant for responding to said first time sequence of events and associated with a given distinct event;

means for generating a second sensorially perceptible time sequence of events, said second sequence generating means including means for generating a plurality of distinct sensorially perceptible events in a predetermined time sequence and for a predetermined time period, said second sequence of events maintaining for a desired period of time a particular at randomly chosen one of said events;

means coupled to said first time sequence generating means and to said participant actuable means for determining the correctness of the participant's response, said correctness determining means providing a first indication when said participant actuable means are actuated in a predetermined sequence corresponding to the first sequence generated by said time sequence generating means and for providing a second indication when said participant actuable means are actuated in a time sequence other than said first time sequence;

means responsive to said first indication for having said first time sequence generating means generate another different time sequence of events, said another of said time sequence of events being one event longer than said the next previous time sequence of events, and for having said second sequence generating means generate another second sequence of events; and means responsive to said second indication for generating an error signal and for having said first time sequence generating means generate another different time sequence of events, said another time sequence of events being one event longer than the next preceding time sequence of events and for having said second sequence generating means generate another second time sequence of events, said another second time sequence of events not including the event associated with the improperly actuated participant actuable means.

16. An electronic game comprising:

a plurality of means actuable by a participant;

means for sequentially selecting one of said participant actuable means to be sensorially perceptible for a predetermined period of time;

means coupled to said selecting means and to said participant actuable means for determining whether said participant has actuated said participant actuable means during the time said selecting means has made said participant actuable means sensorially perceptible, said determining means including means for giving a first indication when said participant actuable means has been properly actuated and a second indication when said participant actuable means has not been properly actuated;

means responsive to said first indication to have said selecting means select at random one of said actuable means to make sensorially perceptible for a predetermined period of time and responsive to said second indication to provide an error signal; and means responsive to the number of times said participant actuable means are properly actuated to decrease the predetermined period of time said participant actuable means are sensorially perceptible.

17. The electronic board game as set forth in claim 16 wherein each said participant actuable means includes two manually operable means, each of which is operable by a different participant, and wherein said determining means including means to detect which said operable means has not been properly actuated when second indication is given by said determining means.

18. A game board comprising:

a portable housing having a top surface with a central panel extending between opposite edges of said housing;

a plurality of manually operable means disposed in said top surface, each of which manually operable means including first and second push buttons with said first push buttons being connected to said central panel and extending toward one side of said housing and with said second push buttons being connected to said central panel and extending toward the other side of said housing;

a plurality of light source means in said housing below said manually operable means, each of said light source means being associated with one of said manually operable means and selectively illuminating said manually operable means;

a control means positioned on the top surface of said housing; and processing means within said housing to control the operation of said board game in accordance with said control means, said processing means including detecting means to detect which of said first and second push buttons have been actuated during the play of the game and said control means including a player actuable decision means which activate said processing means to announce the winner of the game by the selective illumination of said manually operable means.

19. The game board as set forth in claim 18 wherein each of said light source means includes a pair of light sources each being associated with one of said first and second push buttons.

20. The game board as set forth in claim 18 wherein said first and second push buttons are connected to said central panel to form a cantilever so that said first and second push buttons may be depressed adjacent said sides of said housing.

21. The game board as set forth in claim 18 including transducer means controlled by said processing means to generate audible tones associated with the play of the game board.

22. A sequencing game comprising:

means for generating a sensorily perceptable time sequence of events, said sequence generating means including means for generating a plurality of distinct sensorily perceptible events in a predetermined time sequence at a predetermined rate;

means actuable by participant for responding to said time sequence of events;

means coupled to said time sequence generating means and to said participate actuable means for determining the correctness of the participant's response, said correctness determining means providing a first indication when said participant actuable means are actuated in a predetermined sequence corresponding to the sequence generated by said time sequence generating means and for providing a second indication when said participant actuable means are actuated in a time sequence other than said predetermined time sequence;

means responsive to said second indication for generating an error signal and to said first indiction for having said time sequence generating means generate another time sequence of events, said another time sequence of events being one event longer than said previous time sequence of events; and participant selecting means for generating a participant selecting sensorily perceptible time sequence of events, said participant selecting means generating said participant selecting time sequence of events for a first predetermined period of time following each time sequence of events being generated by said time sequence generating means and maintaining sensorily perceptible for a second predetermined period of time the last generated event in said participant selecting time sequence of events.

23. A sequencing game as set forth in claim 22 including manually operable means to control the predetermined time rate.

24. The sequencing game as set forth in claim 22 wherein said correctness determining means includes means for storing a representation of the time sequence generated by said time sequence generating means and means for comparing the stored representation of the time sequence generated by said time sequence generating means with the time sequence generated by said participant actuable means including means coupled to said representation storing means to provide a repetition of the last generated sequence that was followed by a correct participant response.

25. The sequencing game as set forth in claim 22 wherein said participant actuable means includes a plurality of manually operable control means, each associated with a single one of said distinct sensorily perceptible events and actuable by the participant in response to one of said distinct events.

26. The sequencing game as set forth in claim 22 wherein said participant selecting means includes participant deleting means for deleting from any participant selecting time sequence of events any event associated with a participant who has not properly actuated said participant actuable means.

27. A sequencing game comprising:

means for generating a sensorily perceptible time sequence of events, said sequence generating means including means for generating a plurality of distinct sensorily perceptible events in a predetermined time sequence at a predetermined rate;

means actuable by a participant for responding to said time sequence of events;

means coupled to said time sequence generating means and to said participant actuable means for determining the correctness of the participant's response, said correctness determining means providing a first indication when said participant actuable means are actuated in a predetermined sequence corresponding to the sequence generated by said time sequence generating means and for providing a second indication wherein said participant actuable means are actuated in a time sequence other than said predetermined time sequence;

means responsive to said second indication for generating an error signal and to said first indication for having said time sequence generating means generate another time sequence of events, said another time sequence of events being one event longer than the previous time sequence of events; and said time sequence generating means generating each of said time sequences of events twice, said correctness determining means providing a first indication when said participant actuable means are actuated in step with said second repetition of said time sequence of events and providing said second indication when said participant actuable means are not actuated in step with said second repetition of said time sequence of events.

28. The sequencing game as set forth in claim 27 wherein said participant actuable means includes two manually operable means, each of which is operable by a different participant and wherein said correctness determining means includes means to detect which of said manually operable means has not been actuated in step with said second repetition of said time sequence of events when said correctness determining means provides said second indication.

29. The sequencing game as set forth in claim 27 including manually operable means to control the predetermined time rate.

30. The sequencing game as set forth in claim 27 wherein said correctness determining means includes means for storing a representation of the time sequence generated by said time sequence generating means and means for comparing the stored representation of the time sequences generated by said time sequence generating means with the time sequence generated by said participant actuable means and including means coupled to said representation storing means to provide a repetition of the last generated sequence generated by said time sequence generating means that was followed by a correct response.

31. The sequencing game as set forth in claim 27 wherein said participant actuable means includes a plurality of manually operable control means, each associated with a single one of said distinct sensorily perceptible events and actuable by a participant in response to one of said distinct events.

* * * * *